US005490612A

United States Patent [19]

Coquerel et al.

[11] Patent Number: 5,490,612

[45] Date of Patent: Feb. 13, 1996

[54] FUEL DISTRIBUTOR ENABLING, FROM A SINGLE PRODUCT DISTRIBUTOR, TO DEVELOP IT INTO A MULTIPRODUCT DISTRIBUTOR

[75] Inventors: Michel Coquerel, Villerville; Philippe Coquerel, Moult, both of France

[73] Assignee: Equipement Industriel Normand France, France

[21] Appl. No.: 240,835

[22] Filed: May 11, 1994

[30] Foreign Application Priority Data

Mar. 8, 1994 [EP] European Pat. Off. ..... 94400499

[51] Int. Cl.[6] ..... B67D 5/06

[52] U.S. Cl. ..... 222/25; 222/71; 222/74

[58] Field of Search ..... 222/74, 75, 538, 222/71–73, 2, 14, 23, 25–28

[56] References Cited

U.S. PATENT DOCUMENTS 2,128,299 8/1938 Johnsen ..... 222/74 X 4,611,729 9/1986 Gerstenmaier et al. ..... 222/75

FOREIGN PATENT DOCUMENTS 7235099 2/1973 Denmark .

8701483 5/1987 Denmark .

963172 7/1964 United Kingdom .

2242889 10/1991 United Kingdom ..... 222/74

*Primary Examiner*—Kevin P. Shaver

*Attorney, Agent, or Firm*—Kirschstein et al.

[57] ABSTRACT

A fuel dispenser capable of distributing two fuel products by using flexible tubes and automatic distributing nozzles placed on a front side or on a gable side of a basic module is transformed by a rotation of its base over a quarter of a turn and by a rotation of its head over a quarter of a turn, thereby converting the dispenser to distributing multiple fuel products.

4 Claims, 2 Drawing Sheets

FUEL DISTRIBUTOR ENABLING, FROM A SINGLE PRODUCT DISTRIBUTOR, TO DEVELOP IT INTO A MULTIPRODUCT DISTRIBUTOR

FIELD AND PURPOSE OF THE INVENTION

The invention relates to a fuel distributor convertible from a single product distributor to a multiproduct distributor and has for its purpose to allow oil companies and any other investors having or desiring service stations or fuel distribution stations, in tourist lanes or heavy traffic lanes, to limit their investments in proportion to their real needs at that moment.

BACKGROUND OF THE INVENTION

Until about 1983, all service stations or fuel distribution stations were equipped with distributors, more often of the single delivery line and at most of the double delivery line type.

Around 1984 there began to appear on the market multiproduct distributors incorporating from two to four fuels for four to eight distributing nozzles, and even more.

This new distribution mode provides the motorist with a possibility of choosing, at the one and same place, the fuel product corresponding to his or her needs, without compelling him or her to look for the lane having the pump distributing the fuel corresponding to his or her choice. This solution has really been well appreciated by the motorist.

Oil companies or other owners of service and fuel distribution stations have since then invested in multiproduct distributors for part of their main network.

However, there are still thousands of service stations or distribution stations fitted out with old fuel distributors the obsolescence of which, after a ten to fifteen year operation, is really overdue.

This situation compels the oil companies and other operators to urgently replace such obsolete equipment, but the hardships of the times are such that the oil professionals do not have the necessary budgets for investing in multiproduct distributors. Nevertheless, they are compelled to replace tens of thousands of fuel distributors, despite knowing that within four to five years they will have to scrap once more this equipment, although not already paid off, so as to convert little by little their entire network into multiproduct distributors if they wish to keep their customers by offering them a maximum of services.

OBJECT AND SUMMARY OF THE INVENTION

An object of the present invention is to provide the investors, that operate service station chains, with a single or double delivery line distributor which they will be able, without any technical difficulty and for a reduced economic cost, to develop into multiproduct distributors by adding either an extra distribution kit or one or two distributor modules having the possibility in the same location to convert from one to six fuels placed at the disposal of the users.

Another aspect of the invention resides in the fact that the standard fuel distributors, with a single or double delivery line, are always delivered with a distributing nozzle placed frontwardly or on the gable side, that is positioned on the front face or on the side face of the distributor.

The same applies to the distributors according to the invention as long as they are operated as simple distributors.

But as soon as they have to be converted into multiproduct distributors (for example for four fuel products from a single station), a pilot module assembly is pivoted over a quarter of a turn in order to bring the distributing nozzles to the front side; then the module head is turned back over a quarter of a turn so that the windows through which appear the indications "liter", "price per liter" and "price to be paid" become easily visible from the front side of the distributor, thereby facilitating the customer's service.

This pivoting operation of the pilot module should be made without requiring disconnections or reconnections of cables.

According to the invention, the fuel distributor is convertible from a distributor designed for a single fuel product to a multiproduct distributor due to the fact that a basic module, able to distribute two fuel products with the assistance of flexible tubes and automatic distributing nozzles placed on the front side or a gable side of the distributor, is transformed by a rotation over a quarter of a turn of the basic module into a multiproduct distributor having four distributing nozzles on the front side, any by a resetting in position via a rotation over 90 ° of a head of the distributor. Then, above the distributing nozzles, windows show a volume distributed, a unit price and a price to be paid. A common cable enables the operation of displaying counters for four products simultaneously distributed by the base module.

According to another feature of the invention, at least one second base module is attached to a first base module and has a head having no counters, but defining a tunnel adapted for containing either a banking card or a charge card automaton or an equipment for delivering video messages or advertising messages.

Various other features of the invention will become more apparent from the following detailed description.

BRIEF DESCRIPTION OF THE DRAWINGS

An embodiment of the invention is shown by way of a non-limiting example in the accompanying drawings, wherein.

DETAILED DESCRIPTION OF PREFERRED EMBODIMENT

Figure 1A:
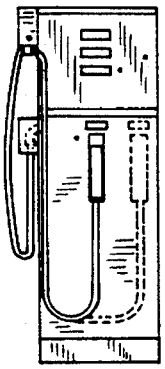
FIG. 1*a*–1*c* are diagrammatic front views of a pilot module, of an intermediate unit and finally of a complementary module respectively.
Figure 1B:
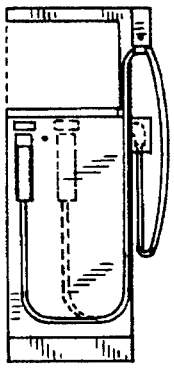
Figure 1C:
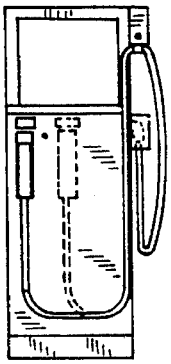
Figure 2:
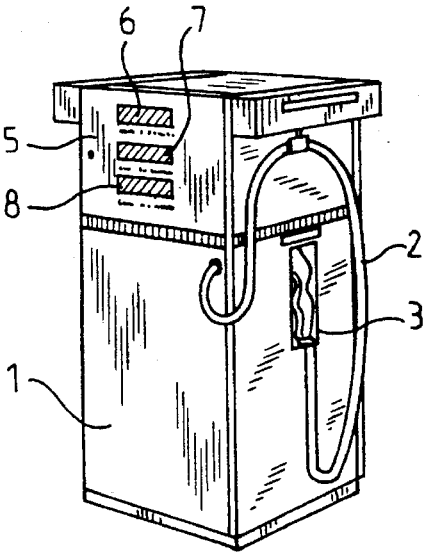
FIG. 2 is a perspective view of a basic module with one or two nozzles.

As shown in FIG. 2, the so-called basic module distributor comprises a base 1 containing the pump(s) for distributing in vehicle tanks a fuel product by using a flexible tube 2 provided with a distributing nozzle 3.

Of course and as this is well known, the distributing head 5 comprises a set of windows 6, 7 and 8 showing an amount of fuel product distributed, a price per liter and a total price.

Therefore, this basic module can be installed in service stations that do not distribute great amounts of fuel products. Actually, with two basic modules (see FIG. 2), one can easily provide for a distribution of fuel products of two, three and even four different grades when the distribution frequency is rather low.

Each basic module comprises, in fact and in general, two distributing nozzles 3 placed on either side of the module.

If the lane where the base 1 is installed becomes a large circulation lane, for example a portion of a highway or a portion of a main roadway, the distributing company is then brought to modify the equipment in order to transform it for example into a pilot equipment (see FIG. 3) in which the base 1 contains four groups of pumps for vertically placing four distributing nozzles. This can easily be done since the basic modules are provided with elements for positioning the necessary pumps and, by simply rotating over a quarter of a turn the basic module assembly and then by bringing back the head 5 by rotating it over a quarter of a turn, there is obtained a pilot distributor (see FIG. 3 ) by simply adding a metering kit mounted on a flexible tube with a distributing nozzle, the whole assembly being shown at 16 in FIG. 3.

There is thus obtained a complete assembly for distributing simultaneously a fuel with two delivery lines.

Figure 3:
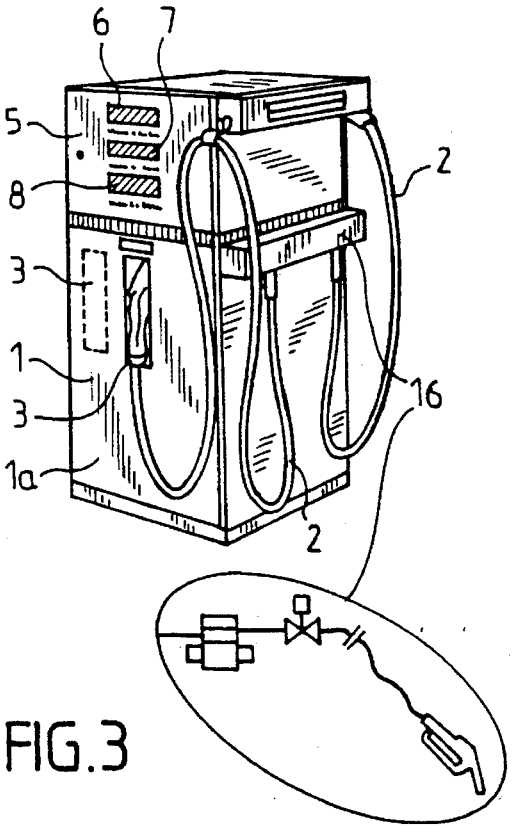
FIG. 3 is a perspective view of a pilot module with two to four distributor nozzles.
Figure 4:
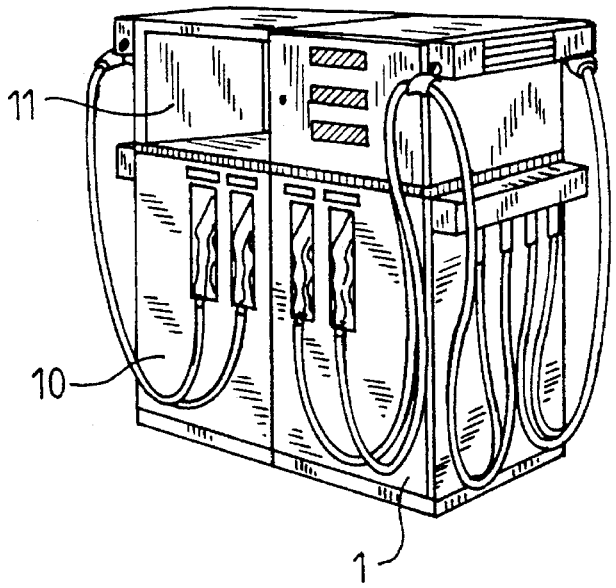
FIG. 4 is a perspective view of a pilot module and basic module assembly fitted with eight distributing nozzles (distribution of at least four different products)

In order to increase the distribution capacity of a pilot module of the type shown in FIG. 3, another module 10 (see FIG. 4) can be added but without a necessity of a counting block formed by the display windows 6, 7 and 8.

So, the module 10 is formed with a tunnel 11 in its upper portion which can receive for example a banking card or a charge card automaton, as is now quite usual.

As already indicated, since the cables are placed in position at the origin, these modifications require only a correct junction of these cables with the counters placed in front of the windows 6, 7 and 8.

It should be noted that the basic modules (see FIG. 2) and the pilot modules (see FIG. 3 ) have a sufficiently large free surface for carrying the mandatory statements regarding the use of these distribution stations as well as the usual trade and service marks.

If this tunnel is not used for a payment services, it can be used for delivering video messages or as an advertising showcase.

Figure 5:
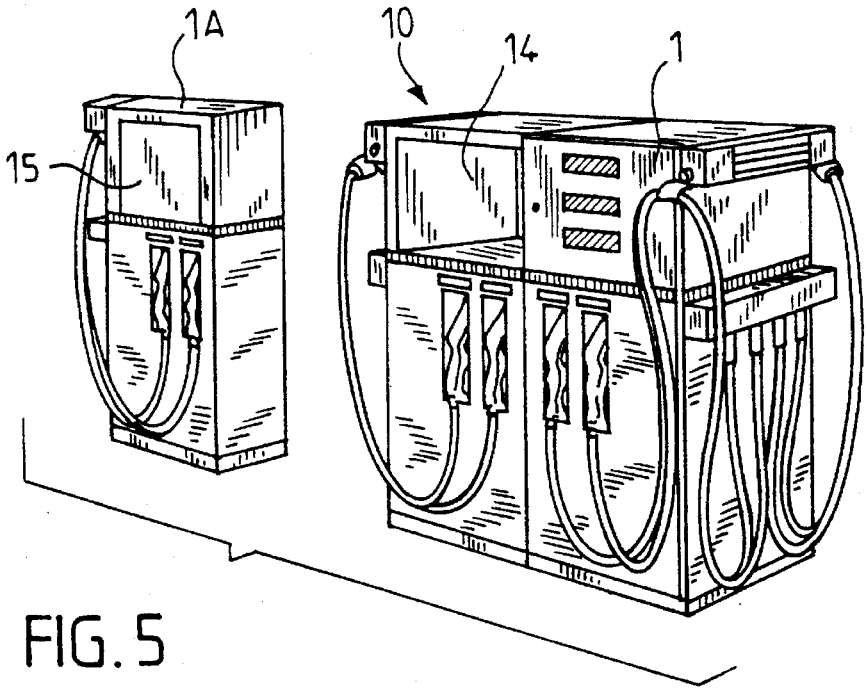
FIG. 5 is a perspective view at a unit with twelve nozzles allowing a distribution, for example of six different products, according to the choice and needs of the customer.

In FIG. 5, the modules 1, 10 are completed with a module 1A identical to the module 1 so as to allow a simultaneous distribution by twelve nozzles of five to six different fuel products.

The various fuels placed at the disposal of the customers can be connected to a banking card or charge card automaton inserted in the tunnel (14, 15), which can also be used as a video display or an advertising showcase.

We claim:

1. A fuel dispenser, comprising:

a) a base having generally planar, front, rear and side walls bounding an upright axis, and housing a pumping station;

b) a nozzle connected to one end of a hose whose other end is operatively connected to the pumping station, said nozzle being mounted on, and accessible to a user at, one of the walls of the base;

c) a head having generally planar, front, rear and side surfaces bounding the upright axis and respectively co-planar with the front, rear and side walls of the base;

d) indicator means visible at one of the surfaces of the head for advising the user of commercial information relating to the fuel being dispensed; and e) means for converting the dispenser from dispensing a single fuel to dispensing a plurality of fuels, by taming the base and the head about the upright axis such that both the indicator means on said one surface of the head and the nozzle on said one wall of the base face in the same direction toward the user, said converting means including a fuel distributor mounted on another of the walls of the base and having an inlet operatively connected to the pumping station, a first outlet connected to the hose, and a second outlet connected to an additional hose that, in turn, is connected to an additional nozzle mounted on a further wall of the base.

2. The dispenser according to claim 1, wherein the indicator means includes a fuel volume indicator, a unit price indicator and a total price indicator.

3. The dispenser according to claim 1, wherein the base has four walls, and wherein the head has four surfaces.

4. The dispenser according to claim 1, and further comprising another base and another head mounted thereon, and wherein said another head has a compartment for receiving equipment for completing a commercial transaction relating to the dispensed fuel, and wherein said compartment faces in said same direction toward the user.

* * * * *